US005253696A

United States Patent [19]

Misra

[11] Patent Number: 5,253,696

[45] Date of Patent: Oct. 19, 1993

[54] METHOD AND APPARATUS FOR CONTROLLING SOLIDIFICATION OF METALS AND OTHER MATERIALS

[76] Inventor: Asoka K. Misra, 159 E. 30 St. Apt. #14A, New York, N.Y. 10016

[21] Appl. No.: 900,561

[22] Filed: Jun. 18, 1992

Related U.S. Application Data

[63] Continuation-in-part of Ser. No. 865,109, Apr. 8, 1992, abandoned, and a continuation-in-part of Ser. No. 876,760, May 1, 1992.

[51] Int. Cl.[5] ..... B22D 27/02

[52] U.S. Cl. ..... 164/48; 164/492; 164/250.1

[58] Field of Search ..... 164/48, 492, 250.1

[56] References Cited

U.S. PATENT DOCUMENTS 5,080,726 1/1992 McKannan et al. ..... 148/1

*Primary Examiner*—Kuang Y. Lin

*Attorney, Agent, or Firm*—Brumbaugh, Graves, Donohue & Raymond

[57] ABSTRACT

High-quality castings are formed by:

(a) placing a molten material in contact with a first electrode formed from a conductive material and a second electrode formed from a semiconductive metal oxide, and (b) passing an electric current between the first second electrodes while the molten material is cooling at a current density of from 10 to 500 mA/cm$^2$.

19 Claims, 4 Drawing Sheets

METHOD AND APPARATUS FOR CONTROLLING SOLIDIFICATION OF METALS AND OTHER MATERIALS

This application is a continuation-in-part of my prior, copending U.S. Pat. applications Nos. 07/865,109 filed Apr. 8, 1992, now abandoned, and 07/876,760 filed May 1, 1992, both of which are incorporated herein by reference.

BACKGROUND OF THE INVENTION

This application relates to a method and apparatus for controlling the solidification of materials such as metals.

In the art of preparing shaped or cast objects by solidification of molten materials such as metals within a mold, it is a recognized goal to control and improve the mechanical properties of the finished product by controlling the solidification process. For example, methods for obtaining castings having a desirable fine grain size have been proposed using low temperature casting, seeding and mechanical or electromagnetic stirring. Haida et al., Trans. Iron Steel Inst. Japan 24 (1984), p. 891; Mizukami et al., Trans. Iron Inst. Japan. 24 (1984), p. 923.

Vibration during solidification is also thought to cause grain refinement by "breaking off" or "melting" the arms of the developing grains. Haida et al., Trans. Iron Steel Inst. Japan 24 (1984), p. 891; Mizukami et al., Trans. Iron Inst. Japan. 24 (1984), p. 923; Jackson, Trans. Metall. Soc. AIME, 236 (1966), p. 149; O'Hara et al., Trans. Metall. Soc. AIME, 239 (1967), p. 497; Johnston et al., Trans. Metall. Soc. AIME, 233 (1965), p. 1856; Tiller et al., "The Solidification of Metals", Iron Steel Inst., Pub. No. 110 (1967), p. 27; Wu et al., Metall. Trans. A, 19A (1988), p. 1109; Cibula, J. Inst. Metals., 76 (1949) p. 34; Southin, J. Aust. Inst. Met., 10 (1965), p. 115; Kura et al., Battle Memorial Inst. Memorandum, No. 166 (May 15, 1963); Alder, The Aust. Eng., (Dec. 8, 1952), p. 53; Hiedemann, J. Acoust. Soc. Am., 26 (1954), p. 831; Tesman, Met. Prog., 79 (1961), p. 79. Grain refinement is achieved by generating strong shear forces in the solidifying liquid metal in a process known as "Rheocasting." Spencer et al., Metall. Trans., 3 (1972), p. 1925; Mehrabian et al., Trans. Am. Foundrymen's Soc., 80 (1972), p. 173; Fascetta et al., Trans. Am. Foundrymen's soc., 81 (1973), p. 95; Young et al., Trans. Am. Foundrymen's Soc., 84 (1976), p. 169; Matsumiya et al., Metall. Trans. B, 12B (1981), p. 17; Laxmann et al., Metall. Trans. A, 11A (1980), p. 1927; Joly et al., J. Mater. Sci., 11 (1976), p. 1393.

The use of electric current to control solidification has also been disclosed. For example, the passage of electric current through solidifying metals has been shown to have an impact on liquid/solid interface stability. Warner et al., Met. Trans., 4 (1973), p. 1245; Angus et al., Met. Soc. Conf., 8 (Inter Science, N.Y., 1961), p. 833; Pfann et al, Trans. TMS-AIME, 224 (1962), p. 1139; Wagner et al., Trans. TMS-AIME, 236 (1966), p. 554; Verhoeven et al., Trans. TMS-AIME, 239 (1967), p. 694; Hurle et al., J. Mat, Sci., 2 (1967), p. 46. The current densities utilized in these studies were significantly high, i.e., well over one thousand A/cm$^2$. Solidification of superalloys in an electric field leading to finer precipitation and improved material properties is disclosed by Ahmed et al., Adv. Mater & Proc. 10, 30 (1991). Recently, pulse electric discharging using pulses of high voltage or current applied to the liquid or semisolid metal. Nakada et al., ISIJ Int'l 30, pp. 27–33 (1990). This generates a large electron pressure gradient in the molten metal, affecting the cast structure.

It is an object of the present invention to provide an alterative method and apparatus for solidification of molten materials which relies upon the continuous passage of low electrical current densities through the molten materials at relatively higher potential.

SUMMARY OF THE INVENTION

In accordance with the invention, high-quality castings are formed by:

(a) placing molten material in contact with a first electrode formed from a conductive material and a second electrode formed from a semiconductive metal oxide, and (b) passing an electric current between the first and second electrodes while the molten material is cooling at a current density of from 10 to 250 mA/cm$^2$. Suitable materials for the first electrode include platinum, silver, copper, nickel, and other conductive metals and metal alloys. Suitable materials for the second electrode include $Fe_2O_3$, $Al_2O_3$, $ZrO_2$, ZnO, $TiO_2$, $CuO_2$, PbO and mixtures thereof.

The method of the invention can be practiced in an apparatus comprising a hollow mold which defines the shape of the cast product, the first and second electrodes and a power supply. The metal oxide electrode is normally located at the bottom of the mold may be formed from the metal oxide. In these situations, the first electrode is placed in contact with the molten material through an opening in the mold. In an alternative arrangement, the oxide electrode may be immersed inside the melt, and the mold can act as the first electrode.

DETAILED DESCRIPTION OF THE INVENTION

Figure 1:
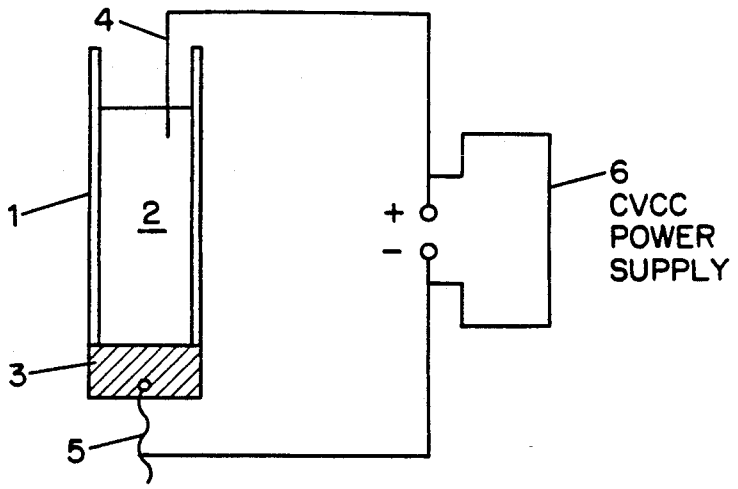
FIGS. 1 and 2 are sectional views through an apparatus in accordance with the invention showing the positioning of the oxide electrode.

In accordance with the invention, high-quality metal castings, ceramic castings (e.g. of halides such as $CaF_2$, KCl, CuCl, KI and sulfides such as CaS, CuS or MgS) and single crystals are made by passing electrical current through a molten material during solidification. FIG. 1 shows a basic apparatus which may be utilized to practice the method of the claimed invention. In FIG. 1 a mold is formed from a wall member 1 and an oxide electrode 3. The oxide electrode 3 is coupled to a connector wire 5 which is electrically connected to a power supply 6. The power supply 6 is also connected to a metal electrode 4.

In use, the mold is filled with molten material 2 and the wire electrode 4 is partially immersed in the molten material 2. As shown in FIG. 1, the wire electrode 4 is advantageously connected to the positive terminal and the oxide electrode 3 to the negative terminal of a dc CVCC type power supply.

The oxide electrode 3 in the apparatus depicted in FIG. 1 can be formed by compacting a metal oxide powder into the appropriate shape for incorporation into the mold apparatus (e.g. a cylindrical disc in the case of FIG. 1). The connecting wire 5 is then inserted into and compacted in situ with the powder. The compacted powder with the wire 5 imbedded is sintered to consolidate the oxide electrode. In general, sintering in air at temperatures of around 900° C. for periods of about one to two hours provide acceptable consolidation.

Figure 2:
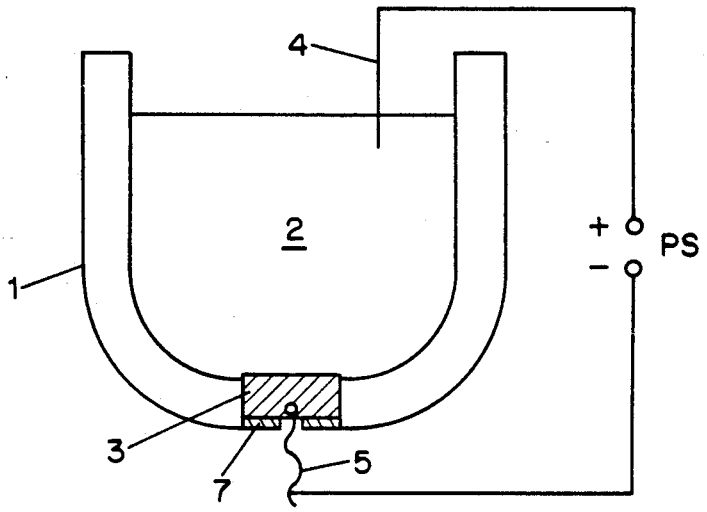

FIG. 2 shows an alternative apparatus in accordance with the invention. In this case, the wall member 1 is shaped near the bottom to form a recess to accept the oxide electrode 3. A suitable high temperature cement 7 may be used to prevent flow of molten material and to affix the electrode 3 in place.

In accordance with the method of the invention, material to be molded is placed in the mold cavity formed by the wall member 1 and the oxide electrode 3 and heated to a temperature sufficient to melt the material. This can be accomplished, for example, by placing the apparatus depicted in FIGS. 1 or 2 in a vertical resistance furnace. The temperature is desirably set to about 50° C. above the melting temperature of the metal being molded and maintained at that temperature for a period of time, e.g. 15 minutes, sufficient to ensure complete melting of the material in the mold. The furnace is then shut off and the cover removed to allow cooling, and thus solidifying, to begin.

Promptly after the furnace has been shut off, the wire electrode 4 is slowly introduced into the melt from the top. The apparatus is connected to the power supply with both current and voltage adjusted to zero. The voltage is then increased to a maximum value that depends on the type of oxide electrode use. In the case of an $Fe_2O_3$ electrode this maximum voltage is about 300 V. For other materials the maximum voltage is determined by the voltage at which current starts to flow through the oxide electrode at the melting temperature of the material to be solidified. Then, the current is gradually increased, for example in 25 mA increments, until a predetermined current level is achieved. Following each incremental increase in the current density, the user should wait until the voltage level stabilizes as indicated on the CVCC power supply meter.

The specific current density employed during any given solidification will depend on the following factors: i) the oxide electrode material in use, ii) the temperature of melting of material being molded. The optimum current density is determined empirically by performing a series of solidifications at varying current densities. In general, lower melting materials will require lower current densities, and high melting materials will require higher current densities. The normal range is from about 10 to 500 mA/cm$^2$, more generally from 25 to 500 mA/cm$^2$. Very low current densities will show no effect on the cast microstructures, whereas, very high current densities will drastically slow down the solidification rate and/or adversely affect the cast structural modification.

Interestingly, it is observed that the voltage required to maintain the current level decreases as the current level increases. For example, when solidifying a Pb-Sb-Sn alloy an initial current of 25 mA at 280 V was employed. By the time the final current density of 250 mA was achieved, the voltage requirement was only 30 V.

The process and apparatus described above can be used to make simple cast products of montotype alloys. It may be suitably employed with low melting alloys such as Pb-Sb-Sn, and with moderate temperature alloys, such as aluminum, copper alloys that melt at around 600° C. Higher temperature alloys such as cast iron, alloy steels, superalloys etc., which melt above 1300° C. will require other oxide material electrode such as $Al_2O_3$ or $ZrO_2$. Indeed, any alloy can be handled in accordance with the invention provided a semiconductive metal oxide electrode is available which will be conductive, but not melt or chemically degrade when in contact with the molten metal. As used herein, the term "semiconductive metal oxide" refers to metal oxides which are nonconductive at room temperature but which become conductive at elevated temperature. Suitable materials, depending on the temperature requirements, include $Fe_2O_3$, $Al_2O_3$, MgO, $ZrO_2$, ZnO, $TiO_2$, $CuO_2$, $SiO_2$ and $WO_2$. Doped semiconductor oxide materials might also be employed to expand the temperature range at which the material will function as an electrode.

In the apparatus of the invention as shown in FIGS. 1 and 2, the wall member 1 may be formed from any material conventionally used to make molds and crucibles for handling molten materials. For example, precipitation type Al-4.5 wt. % copper alloy was solidified by the method of the invention in an apparatus as shown in FIG. 2 in which the wall member 1 was formed of fireclay and the oxide electrode was $Fe_2O_3$. Other suitable crucible materials, depending on the melt temperature of the molten metal include glass, quartz, graphite, alumina, zirconia and magnesia crucibles.

Figure 3:
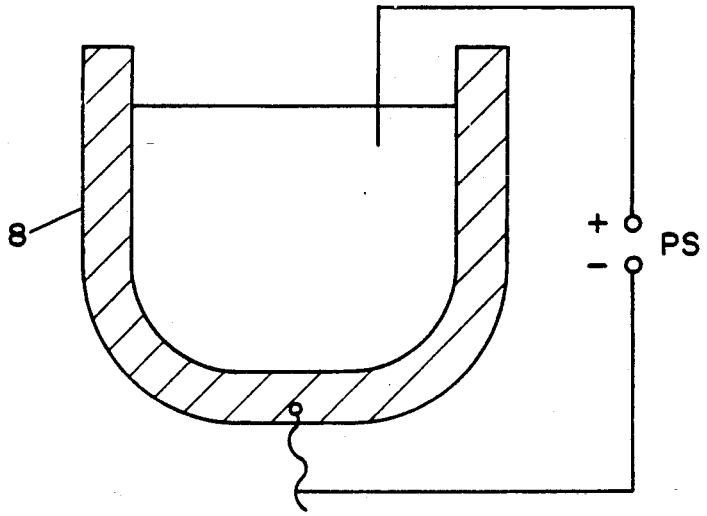
FIG. 3 shows a further embodiment of an apparatus according to the invention in which the entire mold is made of an oxide material.

An alternative to the multi-part mold construction shown in FIGS. 1 and 2 is the use of the oxide electrode material as the entire mold as shown in FIG. 3. An apparatus of this type in which the entire mold/electrode combination 8 was formed of crystallized $Al_2O_3$ was used to solidify cast iron.

Figure 4:
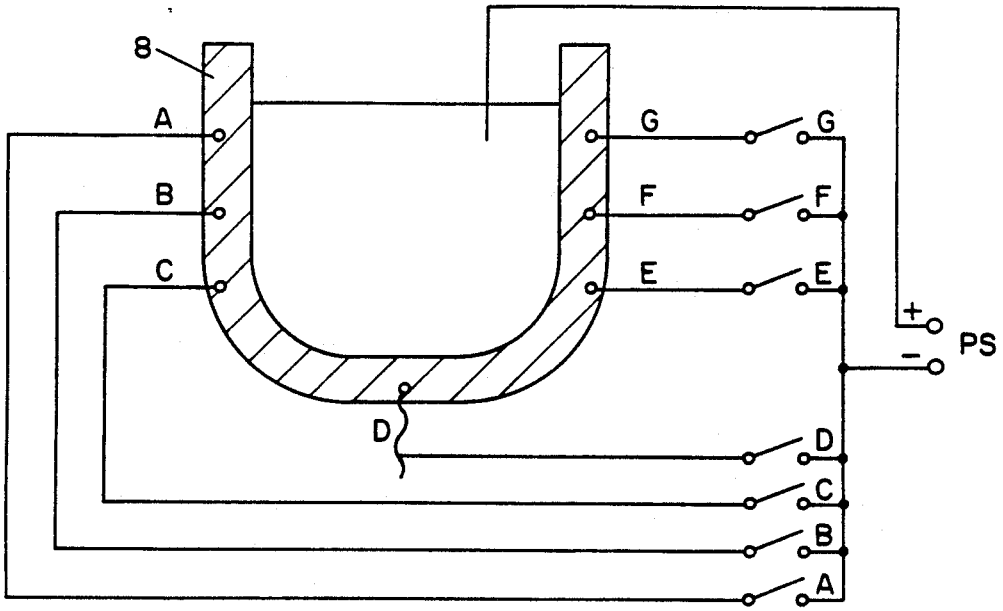
FIG. 4 is similar to FIG. 3 but illustrates alternative electrical connections to the mold for use in the method of the invention.

Beyond the basic method and apparatus which are described above, there are numerous additional refinements and applications of the invention. For example, in FIG. 4 a single piece mold 8 with multiple, independently activated electrical contacts (A–G) is shown. By controlling the manner and sequence of circuit contacts, e.g. with a microprocessor, during solidification, the movement of the solid/liquid interface, and the number of nucleation sites, and thus the ultimate solidification of the cast structure can be controlled.

Figure 5:
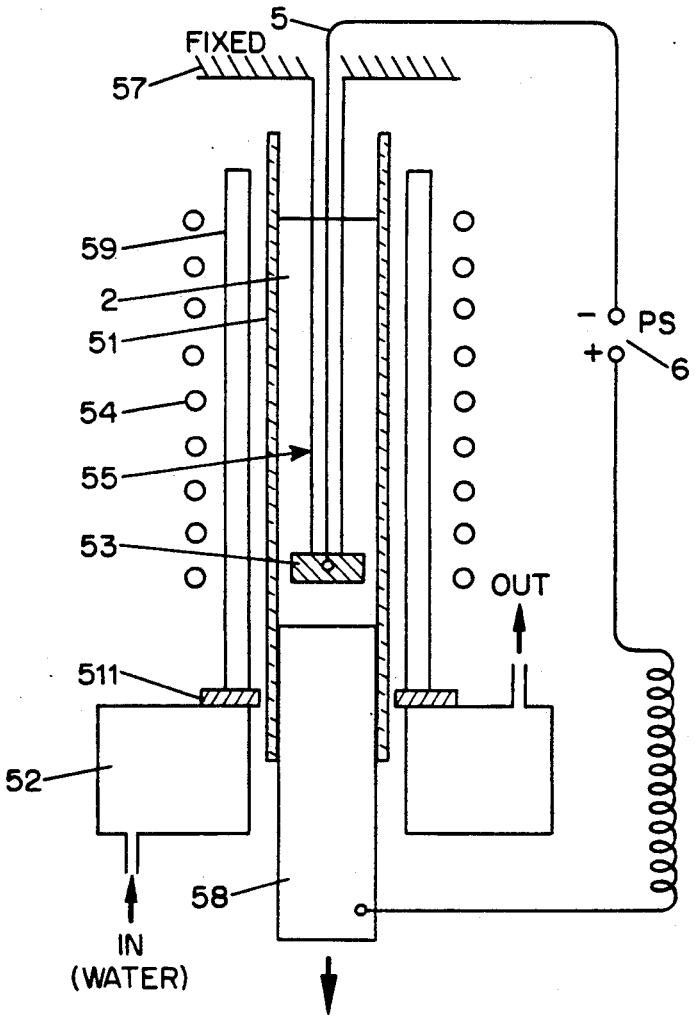
FIG. 5 illustrates an apparatus according to the invention for carrying out directional solidification by Bridgman/Stockbarger technique.
Figure 6:
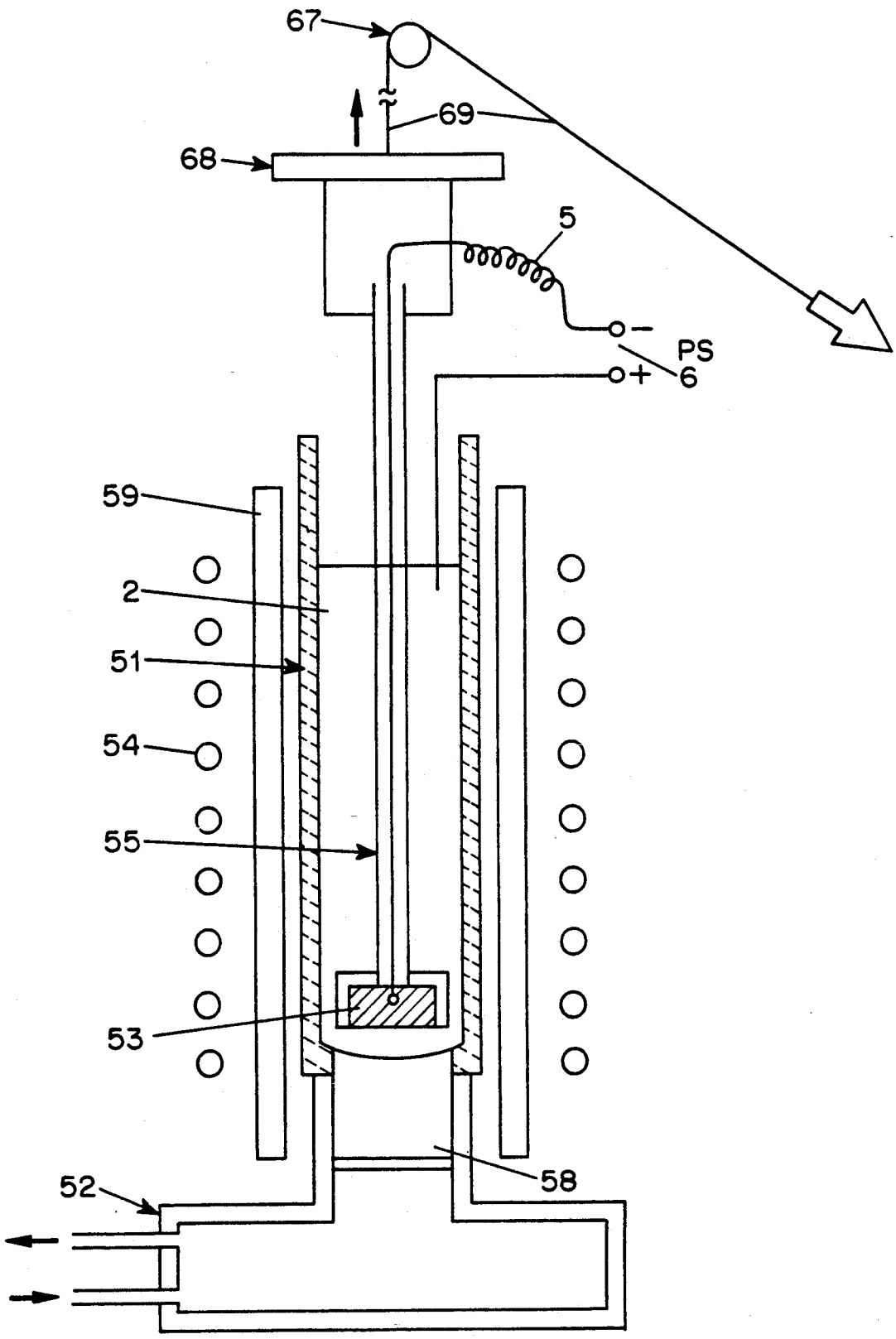
FIG. 6 is a sectional view of a further apparatus in accordance with the invention for use in directional solidification of a melt.

FIGS. 5 and 6 show apparatus useful for directional solidification using the two electrode methodology of the invention. Directional solidification is a process in which heat flow from the casting is controlled so that the grains extend at least substantially unidirectionally. This has been achieved in the past by gradually removing the melt from a heated zone so that the liquid-solid interface progresses linearly from one end of the casting to the other. See U.S. Pat Nos. 1,793,672 and 3,845,808, both of which are incorporated herein by reference. As shown, in FIG. 5 a mold is formed from a wall member 51 and a graphite conductive plug 58 which is connected to the positive terminal of the power supply 6. The oxide electrode 53 is mounted on one end of a support such as a hollow alumina tube 55 and is attached to the negative terminal via the connecting wire 5. The mold and the oxide electrode are moveable relative to one another so that the distance between the oxide electrode and the closed end of the mold can be varied. In this arrangement the oxide electrode holder assembly 57 is fixed and the mold is moveable as shown by the arrow in FIG. 5. Cooling fluid is supplied from a reservoir 52.

At the start induction heating, by induction coil 54 coupled with graphite susceptor 59, is supplied to melt the material 2 in the container. The induction heating is controlled at a fixed temperature above the melting point of the material and the oxide electrode assembly is gradually lowered into the melt till the electrode 53 reaches little above the graphite plug 58 upper surface. At this point the electrode assembly is suitably kept fixed by a mechanical arrangement 57 throughout the directional solidification process. Then the power supply 6 is turned on and the current is increased in steps until the final predetermined current value is attained. Then the gradual withdrawal of the molten metal container formed by wall member 51 and electrode 58 is effected as shown by arrow to start the desired directional solidification. The thermal insulating ring 511 helps create a good temperature gradient. The operation goes on until the total column of the metal melt is directionally solidified and the immersed electrode 3 is completely out of the melt surface which is indicated by a sudden discontinuity in the electrical circuit. Solidification by this method yields greater homogeneity of solutes in the alloy, tends to avoid dendritic solidification, and the cast structure becomes much favorable for better mechanical properties of the material.

FIG. 6 shows an alternative arrangement for performing directional solidification. In FIG. 6, the vessel is fixed and the oxide electrode assembly is affixed to a pulley system including a pulley 67, a counter weight 68, and a cable 69.

The use of an oxide electrode in accordance with the invention has an added benefit because substantial heat is generated at the electrode surface. This heat is imparted to the melt, which is in intimate contact with the electrode surface, and assists in the creation of a high liquid/solid interface temperature gradient ($G_L$). A high temperature gradient is advantageous to better distribution of elements in an alloy melt and to the development of good quality cast microstructure. Further, a high $G_L$ is the controlling factor in production of single crystal metal castings.

Figure 7:
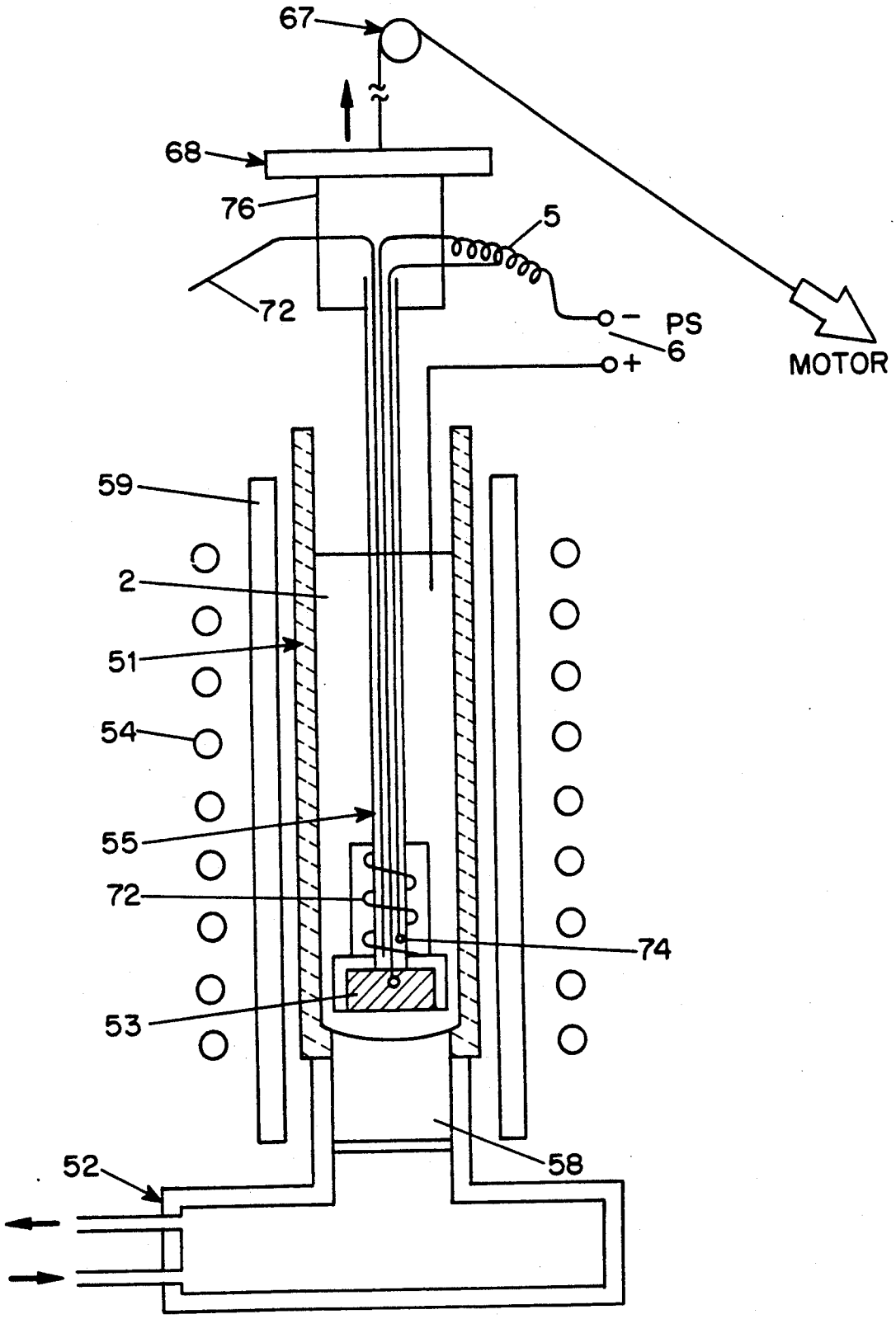
FIG. 7 illustrates an alternative plunger unit arrangement including of a high resistance heating element with an oxide electrode.

This apparatus of the invention may also include a supplemental immersible heater as shown in FIG. 7. In FIG. 7 a coil of resistance wire 72 is wound around the immersed end of the support 55 having an oxide electrode 53 disposed at its end. The ends of the resistance wire 72 pass upwards through the alumina support 55 and are connected to a power supply. A thermocouple 74 can also be included in support 55 to monitor the temperature of the melt. The support 69 is mounted in a holder 76 which is connected to a means for moving the holder and attached 55 support with respect to the mold 51. Suitable means for this purpose include a cable and pulley assembly, as shown, optionally connected to a motor. Alternatively, in the case of a fixed holder (e.g. as shown in FIG. 5) the mold can be moved vertically using a moveable platform.

Advantageously, the motor controlling the relative position of the mold 51 and the resistive heat source 72 are switched on and off in response to the output of the thermocouple 74. Although the oxide electrode will generally provide sufficient heat to enable controlling the melt, if the temperature falls below a defined limit, the motor should be shut off and the heater turned on until the temperature has risen to a second set point. At this temperature, the motor should be activated and the heater turned off. In this way, a near constant temperature profile can be maintained throughout the sample. Similar performance can be obtained using a heater alone without the use of an oxide electrode.

Example 1

Sn-25% wt. Ag alloy was used in quartz tubes of 15 mm diameter (0.D) and the cast metal height was about 150 mm. The melting point of the alloy is 400° C. and the induction heating was controlled at 600° C. The oxide electrode used was of $Fe_2O_3$ material. About 300 mA/cm$^2$ current density at 30 V was maintained during the directional solidification. Inert gas like argon was flushed through the apparatus to avoid any oxidation of the molten metal. Withdrawal of molten pool for directional solidification was carried out at 0.36 cm/min and 1.44 cm/min. The grain structure obtained was much finer without any dendritic structure and much reduced intergranular eutectic phase presence was achieved as compared to materials solidified without the immersed oxide electrode 53 method, i.e., normal directional solidification with all parameters the same but without application of electrical potential as described above.

Example 2

A low melting Pb-Sb-Sn alloy (15% Sb, 7% Sn) was heated in a glass tube 5 mm in diameter and 100 mm long in a vertical resistance furnace to a temperature 50° C. above the melting point. At one end of the tube the melt was in contact with a platinum electrode. At the other end, the melt was in contact with an $Fe_2O_3$ electrode. The furnace was then opened and allowed to cool at its natural cooling rate (a few degrees a minute). A potential of 280 V was applied across the electrodes, through the molten alloy, at an initial current density of 25 mV with a dc CVCC power supply. The current density was increased in steps of about 25 mA until it reached 250 mA and maintained at that level until the material had cooled.

Example 3

Example 2 was repeated using a Pb-Sb-Sn alloy containing 10% Sb and 3% Sn. A material with fine, even grain structure was obtained.

While the foregoing examples illustrate the use of continuous dc current in the invention, pulsed current and ac current may also be employed at substantially the same currents and voltages.

I claim:

1. A method for solidification of a molten material comprising the steps of:

(a) placing molten material in contact with a first electrode formed from a conductive material and a second electrode formed from a semiconductive metal oxide, and (b) passing an electric current between the first and second electrodes while the molten material is cooling at a current density of from 10 to 500 $mA/cm^2$.

2. A method according to claim 1 wherein the current density of from 25 to 500 $mA/cm^2$.

3. A method according to claim 1, wherein the conductive material is a metal selected from the group consisting of platinum, silver, copper, and nickel.

4. A method according to claim 1, wherein the semiconductive metal oxide is selected from the group consisting of $Fe_2O_3$, $Al_2O_3$, MgO, $CuO_2$, PbO, $SiO_2$, ZnO, $TiO_2$, $ZrO_2$ and mixtures thereof.

5. A method according to claim 2, wherein the semiconductive metal oxide is selected from the group consisting of $Fe_2O_3$, $Al_2O_3$, MgO, $CuO_2$, PbO, $SiO_2$, ZnO, $ZrO_2$, $TiO_2$.

6. A method according to claims 1, wherein the current density is progressively increased during the initial part of the cooling to reach a level of from 25 to 500 $mA/cm^2$ and then held essentially constant through the remainder of the cooling.

7. A method according to claim 1, further comprising the step of increasing the distance between the first and second electrodes during cooling.

8. A method according to claim 1, wherein the molten material is a metal.

9. A method according to claim 1, wherein the molten material is a ceramic.

10. An apparatus for solidification of molten materials comprising:

(a) a first electrode formed from a conductive material;

(b) a second electrode formed from a semiconductive metal oxide;

(c) means for connecting said first and second electrodes to a power supply; and (d) a wall member which in combination with either the first electrode or the second electrode forms a mold which imparts a shape to the solidifying material.

11. A apparatus according to claim 10, wherein the conductive material is a metal selected from the group consisting of platinum, silver, copper and nickel.

12. A method according to claim 10, wherein the semiconductive metal oxide is selected from the group consisting of $Fe_2O_3$, $Al_2O_3$, MgO, $CuO_2$, PbO, $SiO_2$, ZnO, $ZrO_2$ and mixtures thereof.

13. A apparatus according to claim 11, wherein the semiconductive metal oxide is selected from the group consisting of $Fe_2O_3$, $Al_2O_3$, MgO, $CuO_2$, PbO, $SiO_2$, ZnO, $ZrO_2$, $TiO_2$, and mixtures thereof.

14. An apparatus according to claim 10, wherein the second electrode is mounted on a support, thereby rendering the second electrode immersible within the mold.

15. An apparatus according to claim 10, further comprising means for varying the distance between the first and second electrodes.

16. An apparatus according to claim 10, wherein the second electrode and the wall member are formed continuously of a single material.

17. An apparatus according to claim 10, wherein the first electrode and the wall member are formed continuously of a single material.

18. An apparatus according to claim 10, further comprising a heater effective to heat the mold and metal.

19. An apparatus according to claim 14, further comprising a heater effective to heat the mold and metal.

* * * * *